US011661808B2

(12) United States Patent
Bodley et al.

(10) Patent No.: US 11,661,808 B2
(45) Date of Patent: May 30, 2023

(54) INFLATABLE DOWN HOLE BAG WITH INFLATION REAGENT RELEASE

(71) Applicant: MTI GROUP PTY LTD, Wangara (AU)

(72) Inventors: Nicholas Bodley, Wangara (AU); Jamie Smith, Wangara (AU)

(73) Assignee: MTI GROUP PTY LTD, Wangara (AU)

( * ) Notice: Subject to any disclaimer, the term of this patent is extended or adjusted under 35 U.S.C. 154(b) by 0 days.

(21) Appl. No.: 17/232,664

(22) Filed: Apr. 16, 2021

(65) Prior Publication Data

US 2021/0230955 A1 Jul. 29, 2021

Related U.S. Application Data

(63) Continuation of application No. PCT/AU2019/051146, filed on Oct. 21, 2019.

(30) Foreign Application Priority Data

Oct. 19, 2018 (AU) ..... 2018903977

(51) Int. Cl.
*E21B 23/06* (2006.01)
*E21B 33/127* (2006.01)

(52) U.S. Cl.
CPC ..... *E21B 23/065* (2013.01); *E21B 33/1277* (2013.01)

(58) Field of Classification Search
CPC ..... E21B 23/065; E21B 33/1277; E21B 33/1208; E21B 33/127; E21B 33/1285;
(Continued)

(56) References Cited

U.S. PATENT DOCUMENTS 3,756,389 A * 9/1973 Firth ..... B65D 81/3266 206/219
4,633,946 A * 1/1987 Jackson ..... G01V 1/104 166/295
(Continued)

FOREIGN PATENT DOCUMENTS

AU 200010114 A1 7/2000
AU 2013222055 A1 3/2014
(Continued)

OTHER PUBLICATIONS

International Search Report and the Written Opinion, PCT/AU2019/051146, dated Apr. 23, 2020, 8 pages.
(Continued)

*Primary Examiner* — Jonathan Malikasim
(74) *Attorney, Agent, or Firm* — Edell, Shapiro & Finnan, LLC

(57) ABSTRACT

An inflatable down hole bag includes an inflatable body for holding an inflation fluid and a container for holding one or more substances. The container is disposed inside of the inflatable body and includes a closure for keeping the one or more substances in the container when the closure is in an inoperative state. The closure also releases the one or more substances from the container when the closure is in an operative state. Release of a substance causes an inflation fluid producing reaction within the inflatable body, thereby inflating the inflatable body. The container includes at least two separated chambers. Each chamber holds a respective one of the substances. The closure includes a stopper for closing a respective opening to one of the chambers. The closure further includes an actuator for removing each stopper from the respective opening so as to release each substance from each respective chamber.

18 Claims, 11 Drawing Sheets

(58) Field of Classification Search
CPC ..... F42D 1/18; B65D 47/121; B65D 81/32; B65D 47/141; B65D 47/20; B65D 81/3283
See application file for complete search history.

(56) References Cited

U.S. PATENT DOCUMENTS

| | | | | |
|---|---|---|---|---|
| 4,846,278 | A * | 7/1989 | Robbins | E21B 23/065 206/532 |
| 6,619,387 | B2 * | 9/2003 | Jenkins | E21B 23/065 53/469 |
| 9,127,651 | B2 * | 9/2015 | Cinquin | G05D 21/02 |
| 9,724,616 | B1 * | 8/2017 | Pedersen | A63H 27/10 |
| 10,450,818 | B2 * | 10/2019 | Jenkins | E21B 23/065 |
| 2013/0312953 | A1 * | 11/2013 | Gane | F42D 1/18 166/187 |

FOREIGN PATENT DOCUMENTS

| | | |
|---|---|---|
| CL | 200202109 | 10/2003 |
| CL | 200403105 | 1/2006 |
| WO | 2012160416 A1 | 11/2012 |
| WO | 2018170551 A1 | 9/2018 |

OTHER PUBLICATIONS

Search Report for counterpart Chilean Patent Application No. 202100963, dated Mar. 21, 2022, 3 pages.

* cited by examiner

INFLATABLE DOWN HOLE BAG WITH INFLATION REAGENT RELEASE

CROSS REFERENCE TO RELATED APPLICATIONS

This application is a continuation of PCT/AU2019/051146 filed Oct. 21, 2019, which claims priority to AU Patent Application No. 2018903977, filed Oct. 19, 2018, the entire disclosures of which are incorporated herein by reference.

FIELD OF THE INVENTION

The present invention relates to inflatable bags for use down a drill hole, such as to provide a platform or plug inside of the drill hole.

BACKGROUND

Inflatable bags are also known with a compressed inflation fluid in a canister, which is released into the bag in a controlled manner. Whilst these types of bags are effective the inflation fluids are typically gasses that have a GWP or health concerns greater than $CO_2$.

Inflatable bags are known to have reagents, such as a carbonate or bicarbonate salt and an acid, which produce an inflation medium (typically $CO_2$) for inflating the bag when it is lowered inside the drill hole. The problem is that the reaction of the reagents needs to be slow enough to position the bag, but quick enough so that time is not wasted waiting for the reaction to be sufficiently progressed for the bag to be inflated enough for it to hold itself in place. A problem with existing solutions is that the reaction time is not sufficiently controlled, or that the reagent(s) clump or otherwise do not properly mix so as to react, or require breakage of a frangible component (typically holding the acid) which risks puncture of the bag from sharp remnants of the frangible component. An alternative is desired.

Any document, reference, patent application or patent that might be cited in this text is expressly incorporated herein in their entirety by reference, which means that it should be read and considered by the reader as part of this text. That the document, reference, patent application, or patent cited in this text is not repeated herein is merely for reasons of conciseness.

In this specification, where a literary work, act or item of knowledge (or combinations thereof), is discussed, such reference is not an acknowledgment or admission that any of the information referred to formed part of the common general knowledge as at the priority date of the application. Such information is included only for the purposes of providing context for facilitating an understanding of the inventive concept/principles and the various forms or embodiments in which those inventive

SUMMARY

According to an aspect of the present invention there is provided an inflatable down hole bag, comprising:

an inflatable body for holding an inflation fluid;

a container for holding one or more substances, the container being disposed inside of the inflatable body;

wherein the container comprises a closure for keeping the one or more substances in the container when the closure is in an inoperative state, the closure also for releasing the one or more substances from the container when the closure is in an operative state;

wherein release of the one or more substances causes an inflation fluid producing reaction within the inflatable body, thereby inflating the inflatable body; wherein, the container comprises at least two separated chambers, each chamber for holding a respective one of the substances, wherein the closure comprises a stopper for closing a respective opening to one of the chambers, wherein the closure further comprises an actuator for removing each stopper from the respective opening so as to release each substance from each respective chamber.

Preferably, the actuator comprises a stopper withdrawing mechanism and a trigger, wherein pressing on the trigger operates the stopper withdrawing mechanism. Typically, the trigger comprises a contact tab for receiving pressure to operate the trigger.

Preferably, the stopper in is an interference fit with the opening. Preferably the stopper comprises an annular rib in the interference fit with a groove of the opening.

Preferably, the stopper mechanism restrains the stopper from opening until the trigger mechanism is activated. Preferably the stopper comprises a releasable holder for restraining the stopper. Preferably, the holder comprises an upper member for preventing upward movement of the stopper relative to the opening. Preferably, the holder comprises a lower member for preventing downward movement of the stopper relative to the opening. Preferably, the stopper comprises a flange extending substantially laterally relative to the opening. Preferably the upper member is disposed above the flange. Preferably the lower member is disposed below the flange and is preferably initially not in contact with the flange, but when the trigger is activated the lower member moves underneath the flange. Preferably, the holder comprises a vertical portion extending between upper member and the lower member. Preferably vertical portion pushes against the flange when the trigger is activated.

Preferably, the stopper withdrawing mechanism comprises a wedge mechanism for lifting the stopper relative to a body of the container.

Preferably, the stopper withdrawing mechanism comprises a pivot mechanism for pivoting a side of the stopper relative to a body of the container.

Preferably, the stopper withdrawing mechanism comprises a wedge mechanism for lifting the stopper relative to a body of the container and a pivot mechanism for pivoting a side of the stopper relative to a body of the container. Typically, the wedge mechanism and pivot mechanism are substantially sequential in operation.

Alternatively, the stopper withdrawing mechanism comprises an engagement mechanism for engaging a portion of the stopper and a pivot mechanism for pivoting a side of the stopper relative to the opening of the container. In an embodiment the engagement mechanism comprises the lower member and the pivot mechanism comprises the vertical portion.

In an embodiment, the inflatable body comprises a reaction bag within the inflatable body within which the container is disposed.

Preferably, the reaction bag comprises a sloped internal surface when the inflatable down hole bag is oriented for lowering into the hole such that the substances are urged to move to a lowermost part of the reaction bag under the influence of gravity.

Preferably, the reaction bag comprises a first reagent substance within one or more dissolvable skins and at least one of the substances within the container is a second reagent capable of dissolving the dissolvable skin, and the first and second reagents when in contact produce or contribute to the production of the inflation fluid producing reaction.

Preferably, the or each dissolvable skin with the first reagent therein is in the form of a tablet. In an embodiment the rate of the inflation fluid producing reaction is selectable by selecting the size of the or each of the tablets.

According to an aspect of the present invention there is provided a container for release of a reactive substance into an inflatable down hole bag, comprising:

a container body for holding one or more substances; and a closure for keeping the one or more substances in the container when the closure is in an inoperative state, the closure also for releasing the one or more substances from the container when the closure is in an operative state;

wherein release of the one or more substances causes an inflation fluid producing reaction within the inflatable body, thereby inflating the inflatable body; wherein, the container comprises at least two separated chambers, each chamber for holding a respective one of the substances, wherein, the closure comprises a stopper for closing a respective opening to one of the chambers. In an embodiment, the closure further comprises an actuator for removing each stopper from the respective opening so as to release each substance from each respective chamber.

In an embodiment, the actuator comprises a stopper withdrawing mechanism and a trigger, wherein pressing on the trigger operates the stopper withdrawing mechanism. Typically, the trigger comprises a contact tab for receiving pressure to operate the trigger.

Preferably, the stopper in is an interference fit with the opening. Preferably the stopper comprises an annular rib in the interference fit with a groove of the opening.

Preferably, the stopper withdrawing mechanism restrains the stopper from opening until the trigger mechanism is activated. Preferably the stopper comprises a holder for restraining the stopper. Preferably, the holder comprises an upper member for preventing upward movement of the stopper relative to the opening. Preferably, the holder comprises a lower member for preventing downward movement of the stopper relative to the opening. Preferably, the stopper comprises a flange extending substantially laterally relative to the opening. Preferably the upper member is disposed above the flange. Preferably the lower member is disposed below the flange and is preferably initially not in contact with the flange, but when the trigger is activated the lower member moves underneath the flange. Preferably, the holder comprises a vertical portion extending between upper member and the lower member. Preferably vertical portion pushes against the flange when the trigger is activated.

In an embodiment, the stopper withdrawing mechanism comprises a wedge mechanism for lifting the stopper relative to a body of the container. In an embodiment, the stopper withdrawing mechanism comprises a pivot mechanism for pivoting a side of the stopper relative to a body of the container. Typically, the wedge mechanism and pivot mechanism are substantially sequential in operation.

Alternatively, the stopper withdrawing mechanism comprises an engagement mechanism for engaging a portion of the stopper and a pivot mechanism for pivoting a side of the stopper relative to the opening of the container. In an embodiment the engagement mechanism comprises the lower member and the pivot mechanism comprises the vertical portion.

According to an aspect of the present invention there is provided a method of inflating a down hole bag, comprising:

providing an inflatable bag having an inflatable body for holding an inflation fluid; the bag comprising a container for holding two or more substances in at least two separated chambers, each chamber for holding a respective one of the substances, the container being disposed inside of the inflatable body, the container comprising a closure which comprises a stopper for closing a respective opening to one of the chambers;

activating an actuator of the container so as to change it from an inoperative state where the one or more substances in the container a held therein to an operative state wherein upon the change from the inoperative state to the operative state removes each stopper from the respective opening so as to release each of the substances of each respective chamber of the container into the inflatable body;

wherein release of the one or more substances causes an inflation fluid producing reaction within the inflatable body, thereby inflating the inflatable body.

According to an aspect of the present invention there is provided a method of opening a container for release of a reactive substance into an inflatable down hole bag, comprising:

providing a container having a body for holding two more substances in at least two separated chambers, each chamber for holding a respective one of the substances; and a closure for keeping the substances in the container when the closure is in an inoperative state, the closure comprises a stopper for closing a respective opening to one of the chambers, the closure also comprising an actuator for releasing the substances from the container when the closure is in an operative state;

activating the closure so as to removes each stopper from the respective opening so as to release the substances such that they cause an inflation fluid producing reaction within the inflatable bag.

Any document, reference, patent application or patent that might be cited in this text is expressly incorporated herein in their entirety by reference, which means that it should be read and considered by the reader as part of this text. That the document, reference, patent application, or patent cited in this text is not repeated herein is merely for reasons of conciseness.

In this specification, where a literary work, act or item of knowledge (or combinations thereof), is discussed, such reference is not an acknowledgment or admission that any of the information referred to formed part of the common general knowledge as at the priority date of the application. Such information is included only for the purposes of providing context for facilitating an understanding of the inventive concept/principles and the various forms or embodiments in which those inventive Various aspects described herein can be practiced alone or combination with one or more of the other aspects, as will be readily appreciated by those skilled in the relevant art. The various aspects can optionally be provided in combination with one or more of the optional features described in relation to the other principal aspects. Furthermore, optional features described in relation to one example (or embodiment) can optionally be combined alone or together with other features in different examples or embodiments.

For the purposes of summarising the aspects, certain advantages and novel features have been described herein above. It is to be understood, however, that not necessarily all such advantages may be achieved in accordance with any particular embodiment or carried out in a manner that achieves or optimises one advantage or group of advantages as taught herein without necessarily achieving other advantages as may be taught or suggested herein.

BRIEF DESCRIPTION OF THE DRAWINGS

Further features of the invention are described in the following description of several non-limiting embodiments thereof. This description is included solely for the purposes of exemplifying the inventive principles. It should not be understood as a restriction on the broad summary, disclosure or description as set out above. The description is made with reference to the accompanying drawings in which.

Figure 1:
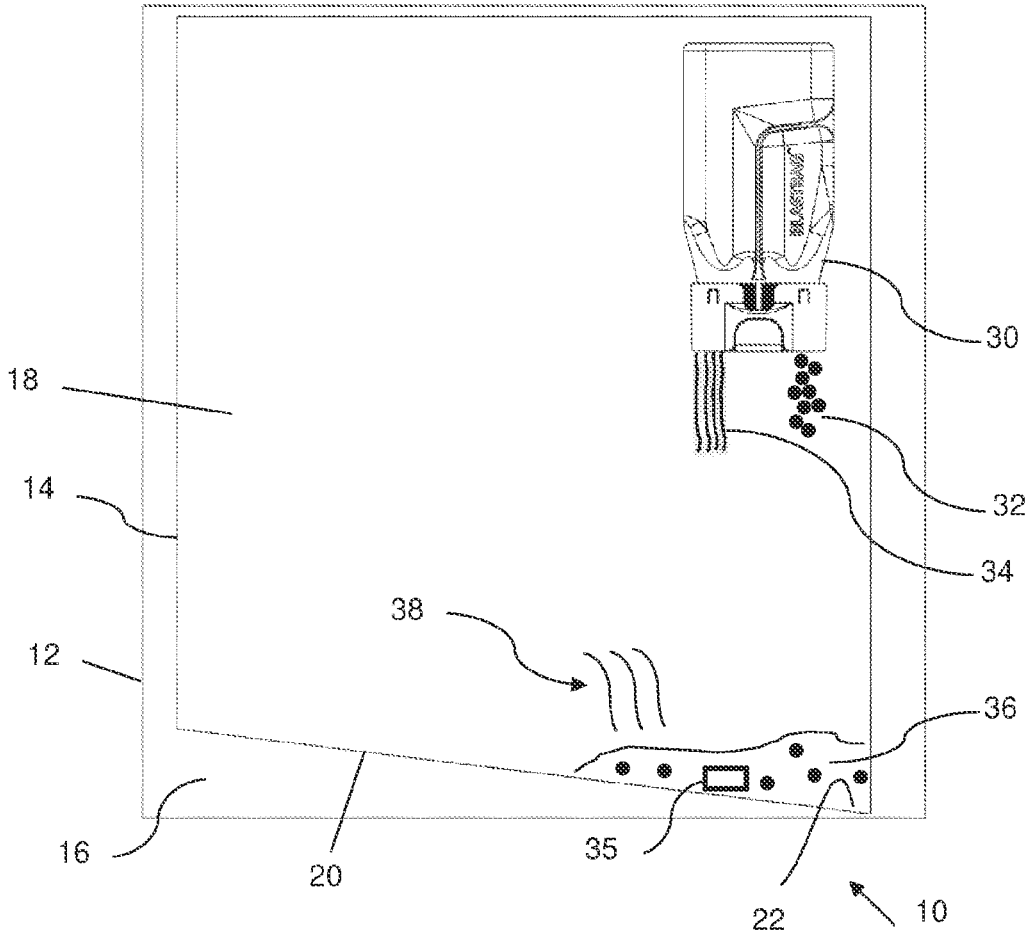
FIG. 1 is a schematic see-through elevation of an inflatable down hole bag according to an embodiment of the invention.

In the figures, like elements are referred to by like numerals throughout the views provided. The skilled reader will appreciate that elements in the figures are illustrated for simplicity and clarity and have not necessarily been drawn to scale. For example, the dimensions and/or relative positioning of some of the elements in the figures may be exaggerated relative to other elements to facilitate an understanding of the various embodiments exemplifying the principles described herein. Also, common but well understood elements that are useful or necessary in a commercially feasible embodiment are often not depicted in order to provide a less obstructed view of these various embodiments. It will also be understood that the terms and expressions used herein adopt the ordinary meaning as is accorded to such terms and expressions with respect to their corresponding respective areas of inquiry and study except where specific meanings have otherwise been set forth herein.

It should be noted that the figures are schematic only and the location and disposition of the components can vary according to the particular arrangements of the embodiment(s) as well as of the particular applications of such embodiment(s).

Specifically, reference to positional descriptions, such as 'lower' and 'upper', and associated forms such as 'uppermost' and 'lowermost', are to be taken in context of the embodiments shown in the figures, and are not to be taken as limiting the scope of the principles described herein to the literal interpretation of the term, but rather as would be understood by the skilled reader.

Embodiments described herein may include one or more range of values (eg. size, displacement and field strength etc). A range of values will be understood to include all values within the range, including the values defining the range, and values adjacent to the range which lead to the same or substantially the same outcome as the values immediately adjacent to that value which defines the boundary to the range.

Other definitions for selected terms used herein may be found within the detailed description and apply throughout. Unless otherwise defined, all other scientific and technical terms used herein have the same meaning as commonly understood to one of ordinary skill in the art to which the embodiment(s) relate.

DETAILED DESCRIPTION

The words used in the specification are words of description rather than limitation, and it is to be understood that various changes may be made without departing from the spirit and scope of any aspect of the invention. Those skilled in the art will readily appreciate that a wide variety of modifications, alterations, and combinations can be made with respect to the above described embodiments without departing from the spirit and scope of any aspect of the invention, and that such modifications, alterations, and combinations are to be viewed as falling within the ambit of the inventive concept.

Throughout the specification and the claims that follow, unless the context requires otherwise, the word "comprise" or variations such as "comprises" or "comprising", will be understood to imply the inclusion of a stated integer or group of integers but not the exclusion of any other integer or group of integers.

Furthermore, throughout the specification and the claims that follow, unless the context requires otherwise, the word "include" or variations such as "includes" or "including", will be understood to imply the inclusion of a stated integer or group of integers but not the exclusion of any other integer or group of integers.

Referring to FIG. 1, there is shown an inflatable down hole bag 10 comprising an inflatable body for holding an inflation fluid. The inflatable body comprises an outer bag 12 and an inner bag 14. The inner bag 14 is inside of the interior 16 of the outer bag 12. The inner bag 14 is smaller in size than the outer bag 12, but large enough so that when inflated it is of a suitable size to fill a circumference of and a portion of the length of a drill hole. Inside 18 of the inner bag 14 is a container 30 for holding one or more reagent substances. The inside of the bag 14 may also comprises one or more reagent substances are described further below.

Figure 2:
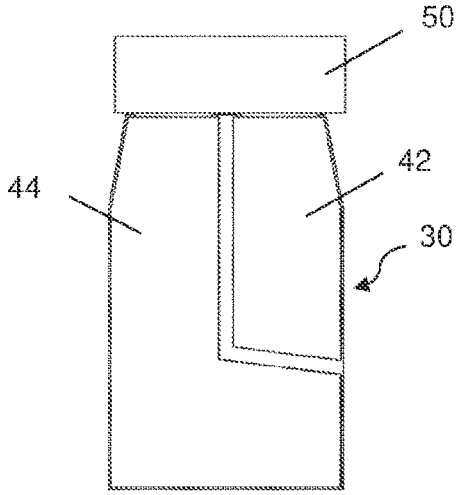
FIG. 2 is a schematic elevation of a reagent container according to an embodiment of the invention, with a closure in place, and the container oriented to be in a preferred activation position, which is inverted from its operational position.
Figure 3:
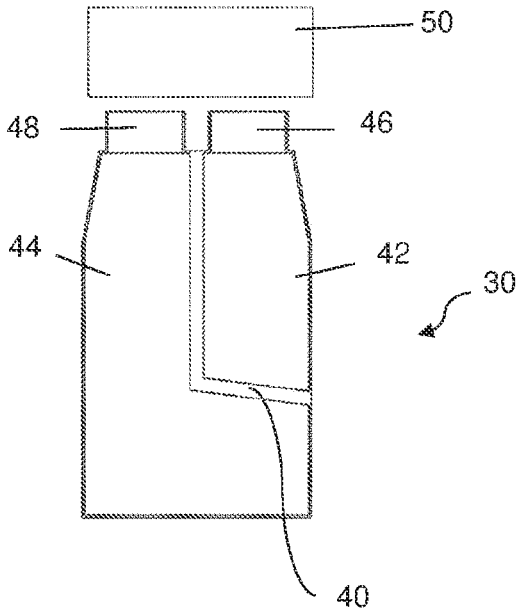
FIG. 3 is a schematic rear elevation of the reagent container of FIG. 2, with the closure of the container removed.
Figure 4:
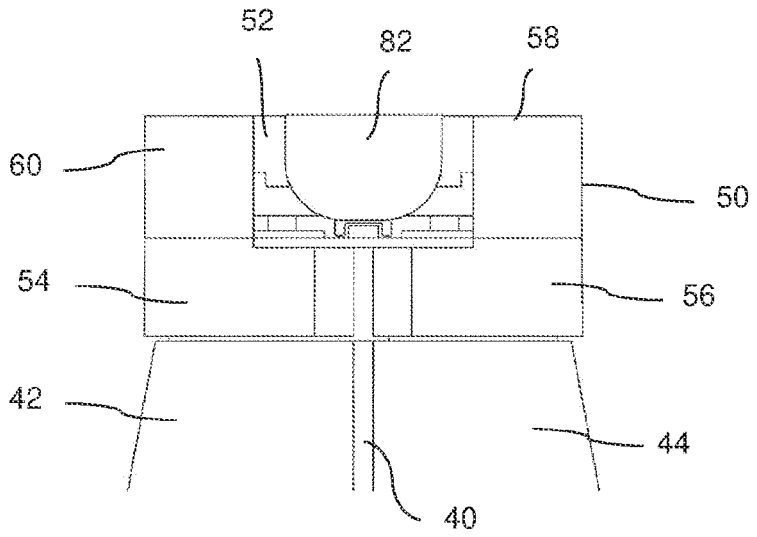
FIG. 4 is a front elevation of the closure of FIG. 2.
Figure 5:
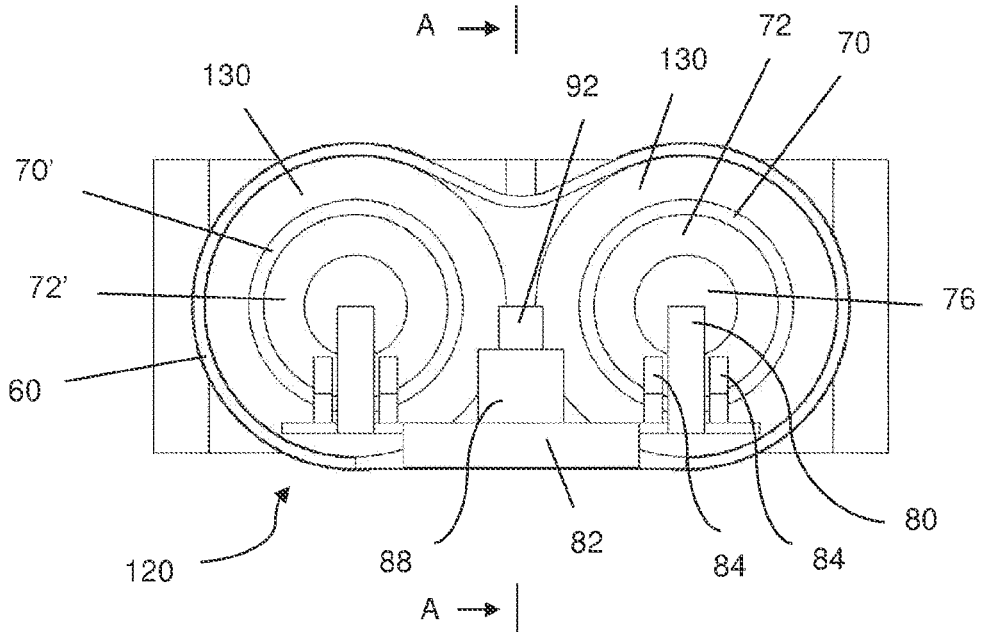
FIG. 5 is a plan view of the closure of FIG. 2, in an inoperative state.

Referring to FIG. 2, the container 30 comprises a closure 50 for keeping the one or more reagent substances in the container when the closure is in a closed configuration of an inoperative state. The closure 50 is also able to release the one or more reagent substances (for example a salt 32 and an acid 34) from respective chambers (in this case chambers 42 and 44) of the container 50 when the closure 50 is in an open configuration of an operative state.

The released reagent substances 32 and 34 mix at 36 and (chemically) react causing release of an inflation fluid 38, such as carbon dioxide ($CO_2$) gas, thereby inflating inner bag 14, and in turn the outer bag 12, and thus the inflatable body.

The inside 18 of the inner bag 14 houses the reaction. In order to aid in the mixing of the reagent substances the inner reaction bag 14 comprises a sloped internal surface 20 when the inflatable down hole bag 10 is oriented for lowering into the drill hole such that the substances are urged to move to a lowermost part 22 of the reaction bag under the influence of gravity. Further the container 30 is fixed (such as by adhesive) to a side wall of the inner bag 14 so as to be disposed relatively high above the lowermost point 22. The drop of the falling substances 32 and 34 from the container 30 on impact with the mix 36 preferably causes agitation to the mix 36, thereby encouraging complete reaction of the substances and avoiding clumping. Such is useful when faster reaction time (and in turn inflation time) is desired.

However, a slower reaction time may also be desired. In that instance one or some of the reagent substances may be within a tablet 35 having (or not having) a dissolvable skin or coating. Thus, for instance when liquid, such as acid 34, is released from the container the acid will begin to dissolve the skin of the tablet 35, or the tablet 35 will be designed to be a rapidly dissolving tablet (RDT). As the acid contacts the reagent substance(s) therein (such as bicarbonate or carbonate salt) this will react thereby creating the inflation fluid 38, but only after the delay of the acid dissolving the skin has occurred. The reaction rate can also be controlled by the size of the tablet or tablets 35, due to the reaction rate being dependent on the surface area of the or each tablet 35 undergoing reaction or the tablet composition as in the case of a RDT without a skin.

The tablet(s) 35 may be loose within the inner bag 14, adhered to a position in the region of the lower most point 22 or released from the container 30.

It will be appreciated that reagent substances other than a carbonate/bicarbonate salt and an acid may be used and indeed more than two reagent substances may be used. For example, the acid may be in a dry solid form (eg. citric acid granules) that is activated when wet, such as by the release of water from one or the chambers of the container 30. Further the container 30 may only have one of the reagent substances when another is already in the inner reaction bag 14.

The amounts/proportions of the reagent substances can be selected for the size of the bag 10 and the amount of inflation fluid 38 to be produced. In this example chamber 42 is smaller than chamber 44 and the chambers 42 and 44 are connection by a web 40. In an embodiment the chambers 42, 44 have screw tops 46 and 48, respectively. A cap 130 having a hole 100 substantially axially therethough is screwed to each screw top 46, 48. In the hole 100 is a stopper having a disc portion 72 which is held in placed by an interference or taper fit (such as a snap fit arrangement). The hole 100 is defined by a lip 70.

Figure 18:
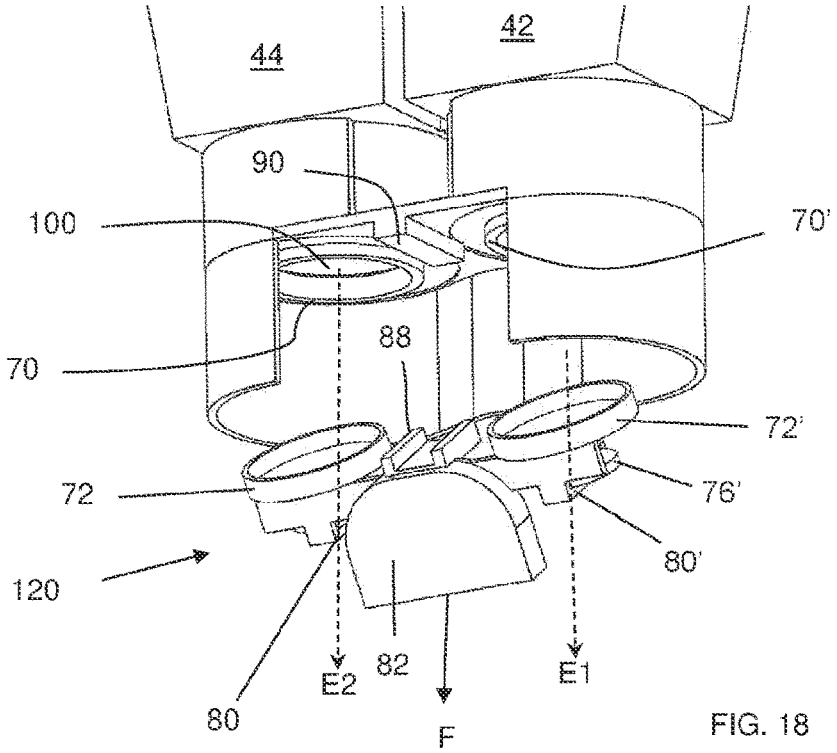
FIG. 18 is a lower isometric view of the closure with a stopper mechanism being released from the remainder of the closure, so that the closure is in the operative state.
Figure 19:
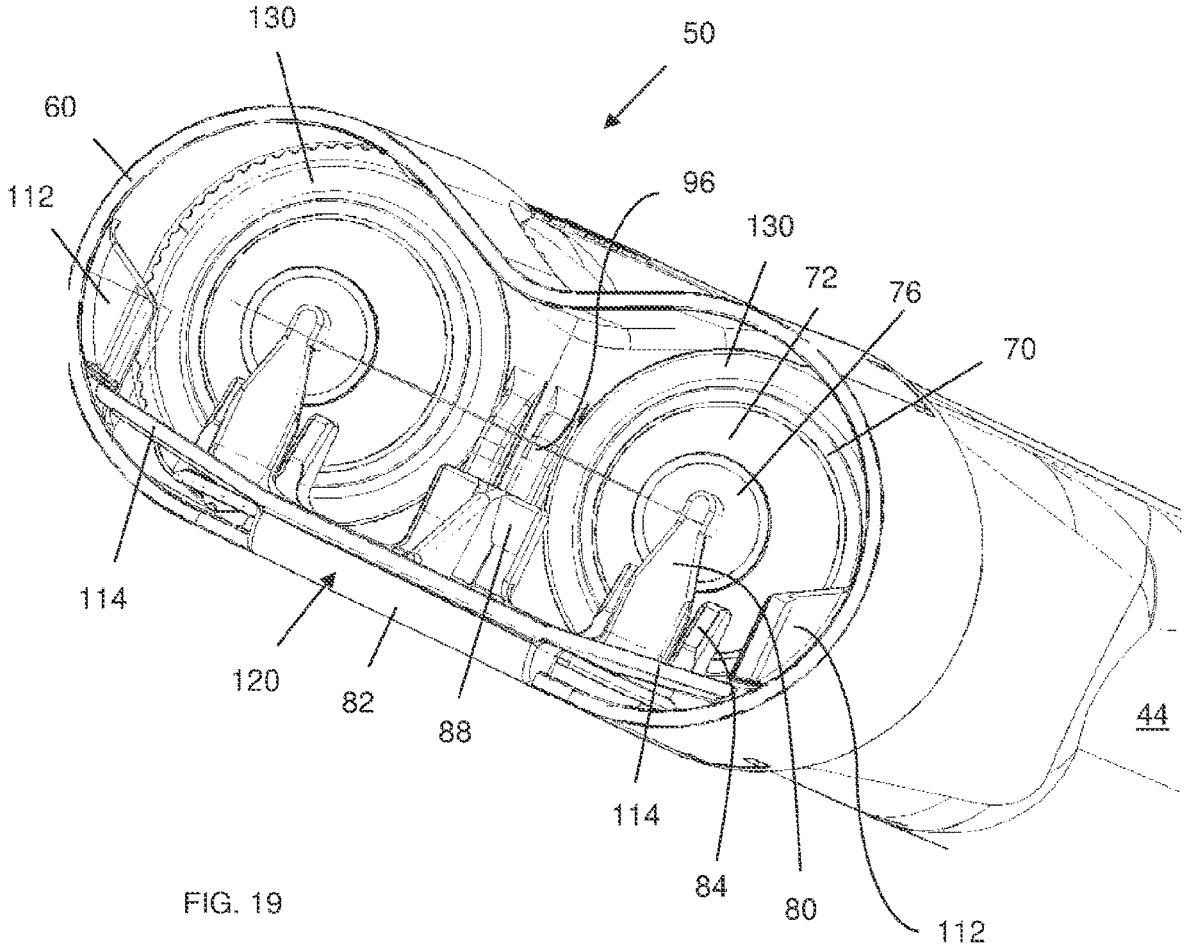
FIG. 19 is an isometric view of an alternative embodiment of the closure of FIG. 2.

Referring to FIG. 19, an embodiment of the closure 50 comprises the caps 130, a release actuator assembly 120 (shown separated in FIG. 18) and a skirt 60, which is clipped to the underside of the caps 130 so as to hold the skirt 60 in place. As shown in FIG. 19, the release actuator assembly 120 is held in place within the skirt 60 by wings 114 extending from a tab 82, in the form of a plate, of the release actuator assembly 120. The wings 114 interfere with protrusions 112 on the inside of the skirt 60. In an embodiment, the skirt 60 extends down (when oriented as per FIG. 1) from the container end of the caps 130, across the height of the caps 130 as indicated by 54, 56, and to a distance that houses the release actuator assembly 120. The skirt 60 has a void therein for housing the release actuator assembly 120. The void also allow allows clear passage of the reagent substance 32, 34 exiting the container 30 when the release actuator assembly 120 has being activated. The skirt 60 also has an opening 52 in a side which allows pressing or contact with plate 82 so as to trigger activation of the release actuator assembly 120.

In an embodiment, the release actuator assembly 120 comprises a stopper withdrawing mechanism and a trigger, wherein pressing on the trigger operates the stopper withdrawing mechanism. The trigger comprises the plate 82 for receiving pressure to operate the trigger. Each stopper 72 (and 72') comprises a disc forming the body of the stopper 72 which seals the respective hole 100 in the respective cap 130, which hole 100 is defined by the respective lip 70 (and 70'), an axially aligned projection 74 (see FIGS. 6 and 7) and a hat 76 preferably in the form of a circular flange. The projection 74 and the hat 76 form a T-shape in cross section as best seen in FIG. 7, and with the disc, form an H shape in cross section.

The skirt 60 also comprises a platform 90 between the lips 70, 70'. The release actuator assembly 120 further comprises a wedge member 84, a latch 80 and a slide 88. The release actuator assembly 120 moves as the tab 82 is pushed. In particular the slide 88 slides over the platform 90 as the tab 82 is pushed. The wedge member 84 projects from the tab 82 and has a clearance 92 underneath it. The wedge member 84 has a sloped surface portion as seen in FIG. 7 and an upper surface portion substantially parallel with the slide 88. The distance between the upper surface portion and the underside is substantially the same as the distance between the hat 76 and the disc part of the stopper 72. The latch 80 also projects from the tab 82 and has a hooked end as seen in FIG. 7. The latch 80 is of a length substantially the same as the diameter of the hat 76.

Figure 6:
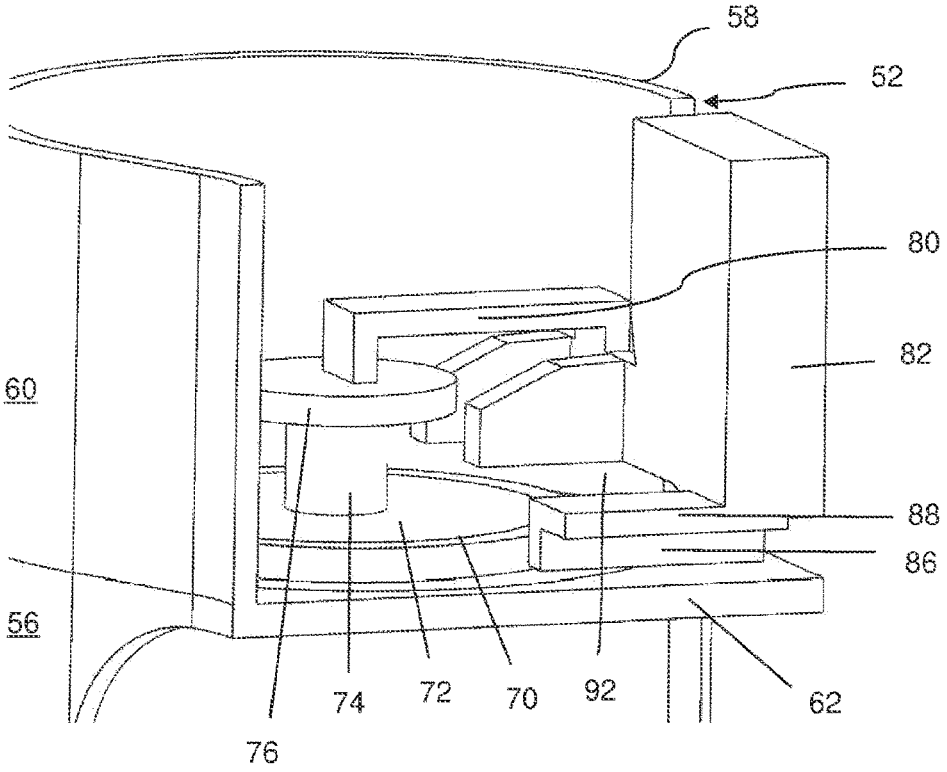
FIG. 6 is an isometric view of a cross section through A-A of FIG. 5, in the inoperative state.
Figure 7:
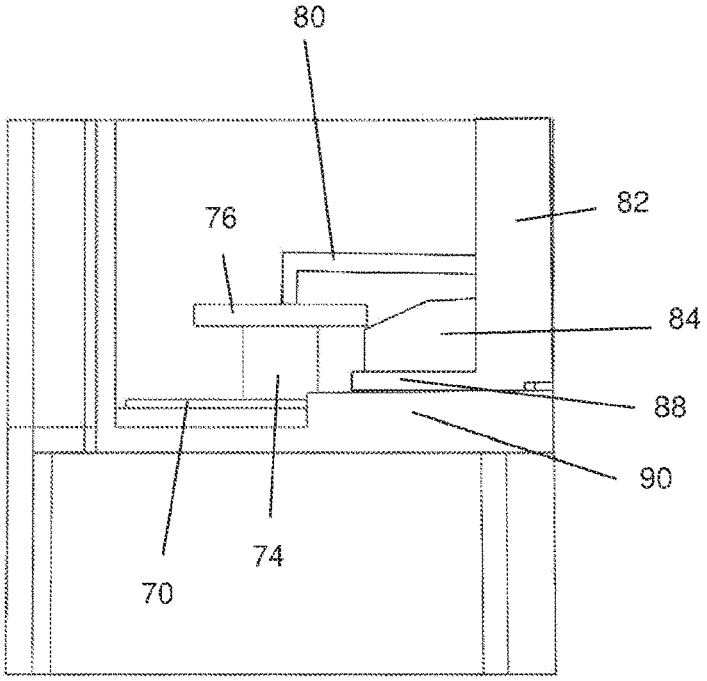
FIG. 7 is an elevation of the cross section through A-A of FIG. 5, in the inoperative state.
Figure 8:
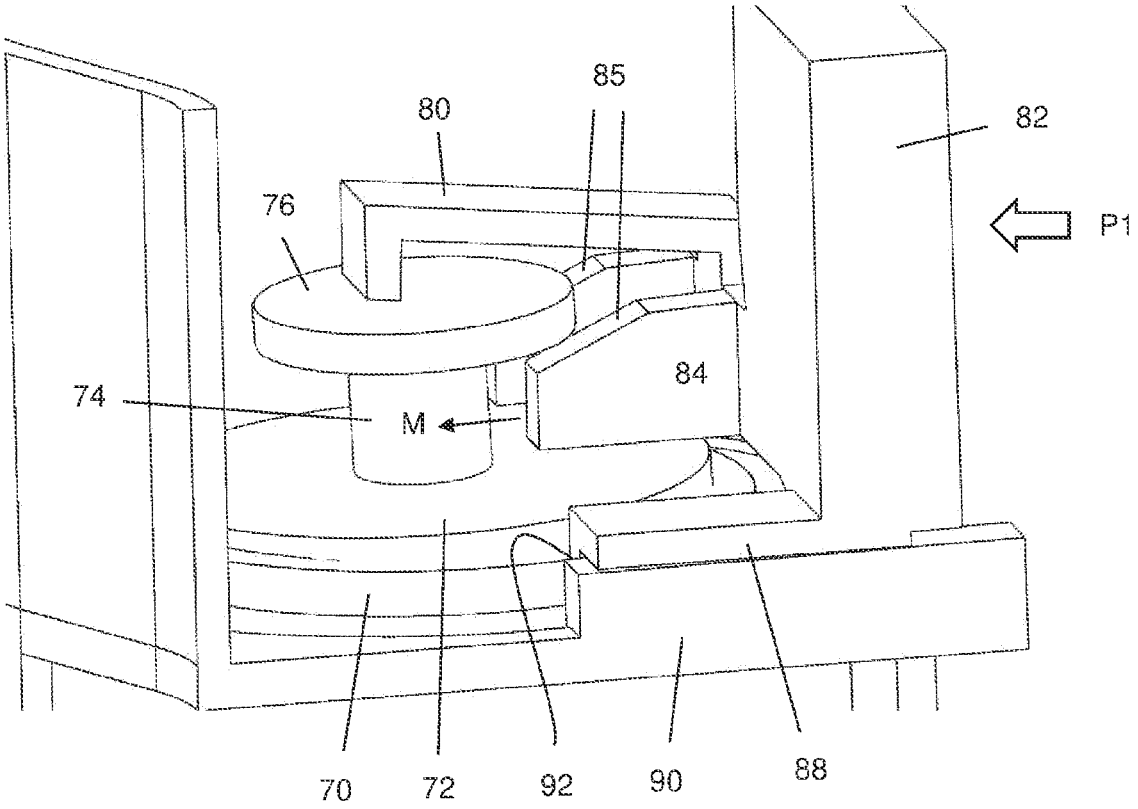
FIG. 8 is an isometric view of a cross section through A-A of FIG. 5, at a first transition point between the inoperative state and an operative state.

The release actuator assembly 120 is in an inoperative state as shown in FIGS. 6, 7 and 19. To operate the release actuator assembly 120 a user presses the tab 82 as indicated by P1 in FIG. 8.

Figure 9:
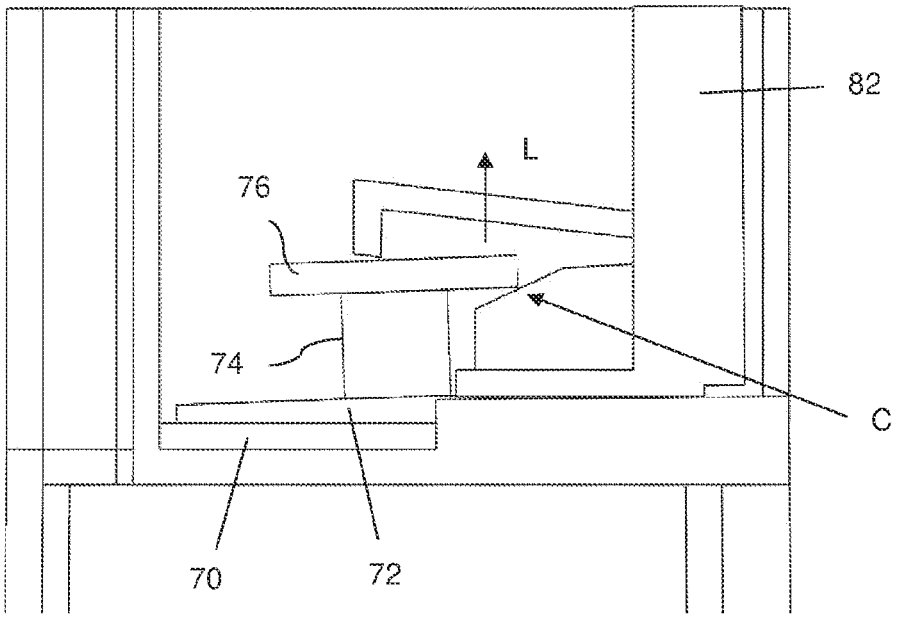
FIG. 9 is an elevation of the cross section through A-A of FIG. 5, in the first transition point of FIG. 8.

Pressing the tab 82 causes the wings 114 to flex until they are released from the protrusions 112, such that the protrusions no longer hold the wings 114 and thus the release actuator assembly 120 captive in the skirt 60. Further, slide 88 moves along the platform 90 and the wedge member 84 moves into the space between the hat 76 and the disc of the stopper 72 until the sloped surface portion contacts the hat 76 as indicated by C in FIG. 9. Contact of the sloped surface portion of the wedge member 84 as movement L occurs lifts the hat 76 as indicated by L, in FIG. 9. Lifting of the hat 76 causes lifting of the disc of the stopper 72 out from its interference fit in the hole defined by the lip 70. In an embodiment this occurs at one side of the stopper 72.

In an embodiment (not shown) the platform or the slide may comprise a ramp for adding a displacement of the wedge member 84 to the action (providing a similar effect to the wedging of the wedge member 84) with movement of the release actuator assembly 120.

Figure 10:
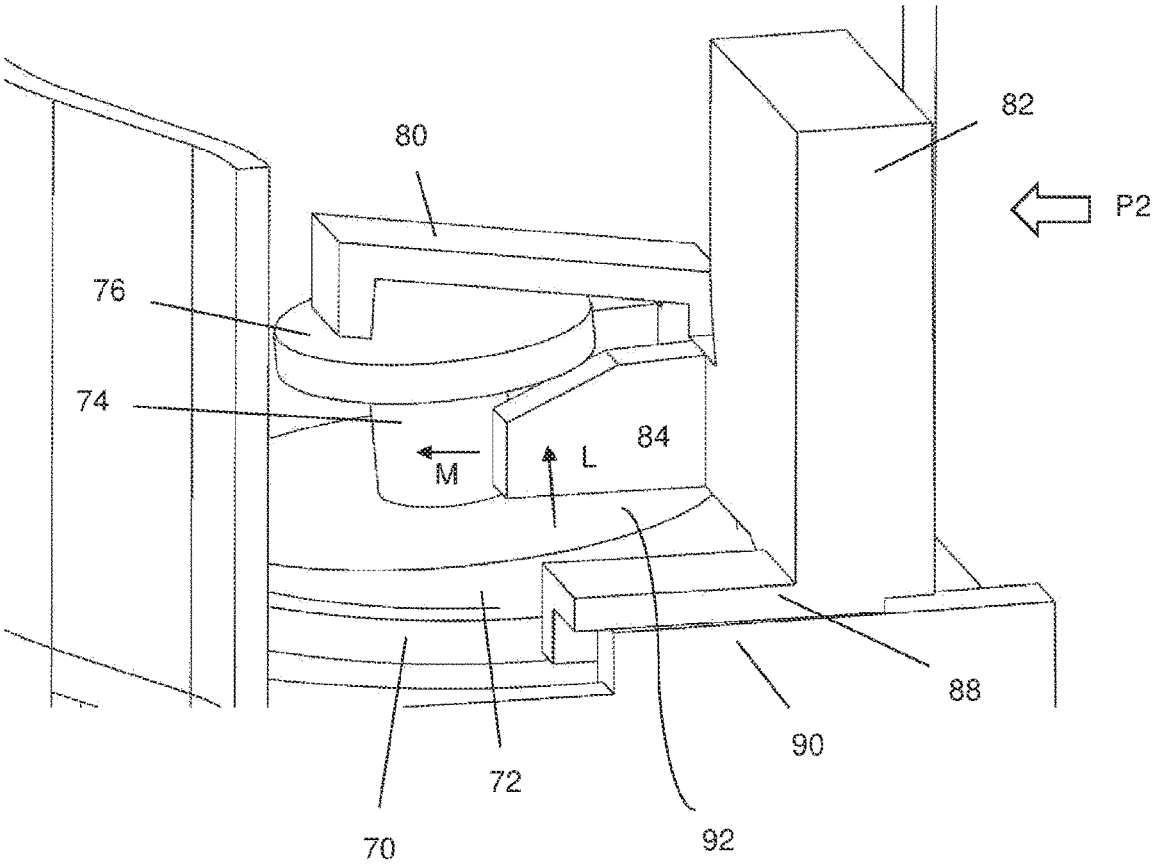
FIG. 10 is an isometric view of a cross section through A-A of FIG. 5, at a second transition point between the inoperative state and the operative state.

As the tab 82 continues to be pushed, as indicated by P2 in FIG. 10, the wedge member 84 continues to be inserted between the hat 86 and the disc of the stopper 72 and this continues to lift the hat 76 and thus the stopper 72. The disc of the stopper 72 moves into the clearance 92. The hook of the latch 80 moves across the upper surface of the hat 76. The latch 80 may be bent along its length as this occurs.

Figure 11:
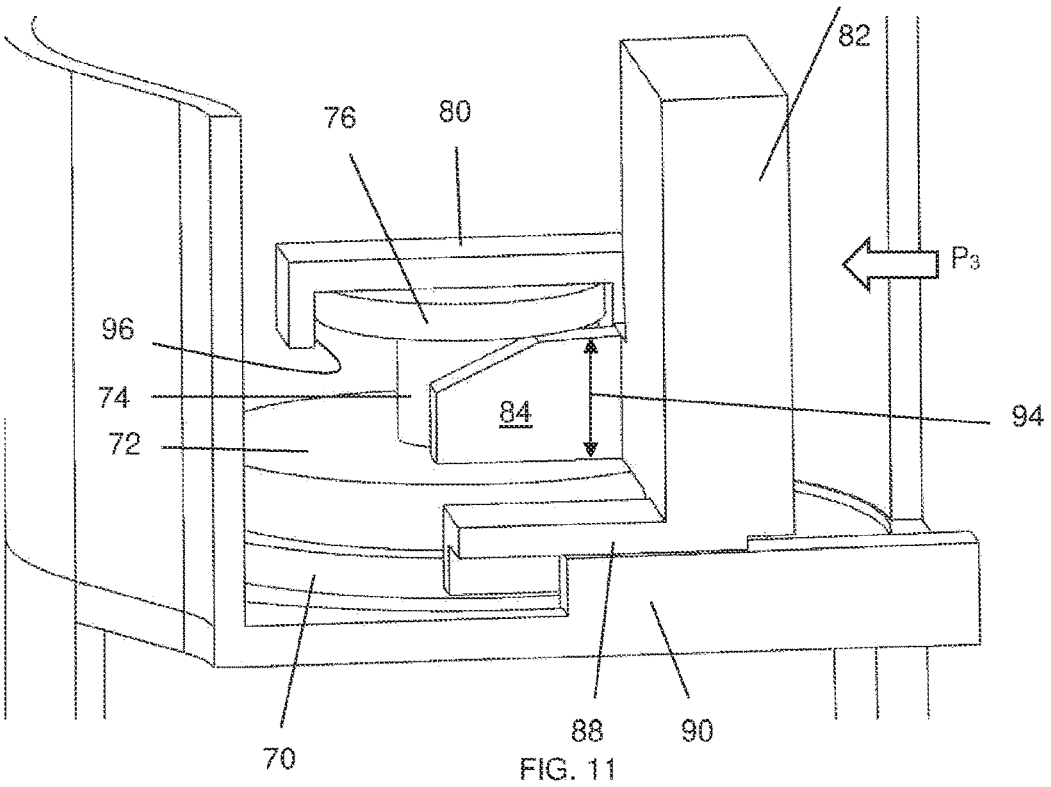
FIG. 11 is an isometric view of a cross section through A-A of FIG. 5, at a third transition point between the inoperative state and the operative state.
Figure 12:
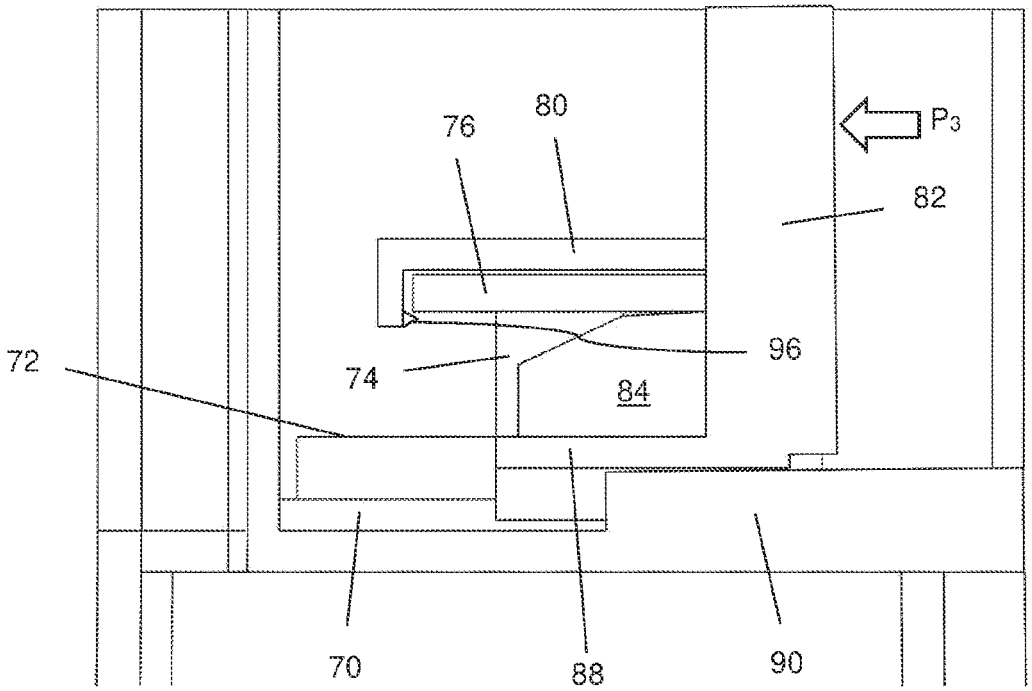
FIG. 12 is an elevation of the cross section through A-A of FIG. 5, in the third transition point of FIG. 11.

As the tab 82 is continues to be pushed, as indicated by P3 in FIG. 11, the wedge member 84 continues to be inserted between the hat 86 and the disc of the stopper 72 until the upper surface portion contacts the hat 76. In an embodiment the disc of the stopper 72 is at least partly (and in some embodiments fully) removed from the hole 100. The hooked end 96 of the latch 80 (resiliently) falls off the upper surface of the hat 76 and latches onto the hat 76. The stopper 72 via the hat 76 is thus held by the release actuator assembly 120 via the latch 80.

Figure 13:
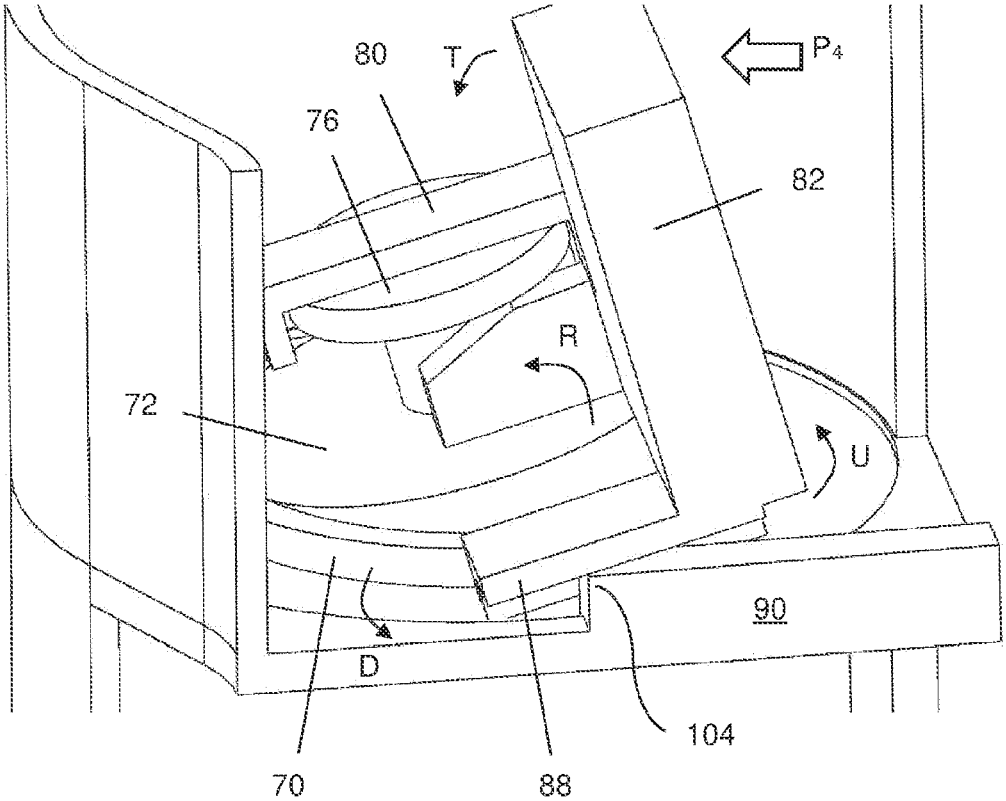
FIG. 13 is an isometric view of a cross section through A-A of FIG. 5, at a fourth transition point between the inoperative state and the operative state.
Figure 14:
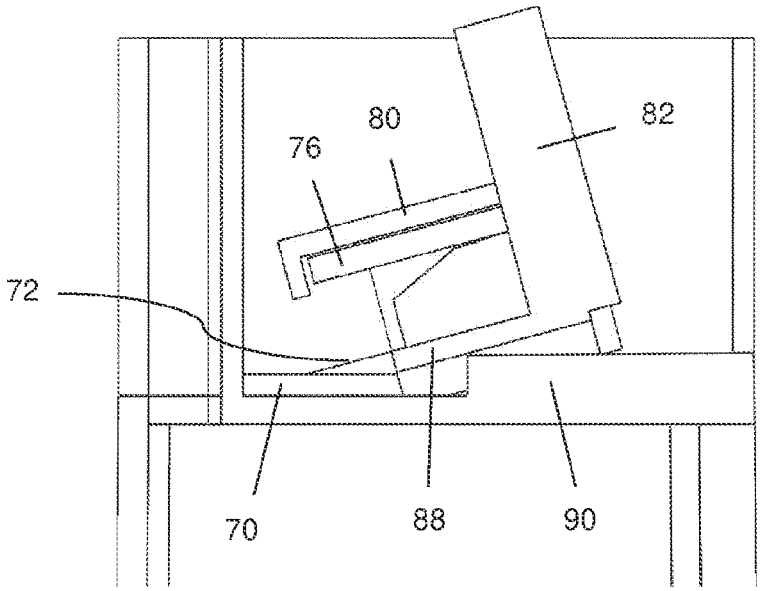
FIG. 14 is an elevation of the cross section through A-A of FIG. 5, in the fourth transition point of FIG. 13.

As the tab 82 is continues to be pushed, as indicated by P4 in FIG. 13, the slide 88 falls off the stepped end of the platform 90 as indicated by D (or in the embodiment shown in FIG. 19 runs down a slide 96) causing the tab 82 to pivot as indicated by U and T. In turn the stopper 72 will pivot as indicated by R. The pivoting is about the side of the stopper 72 opposite the tab 82.

Figure 15:
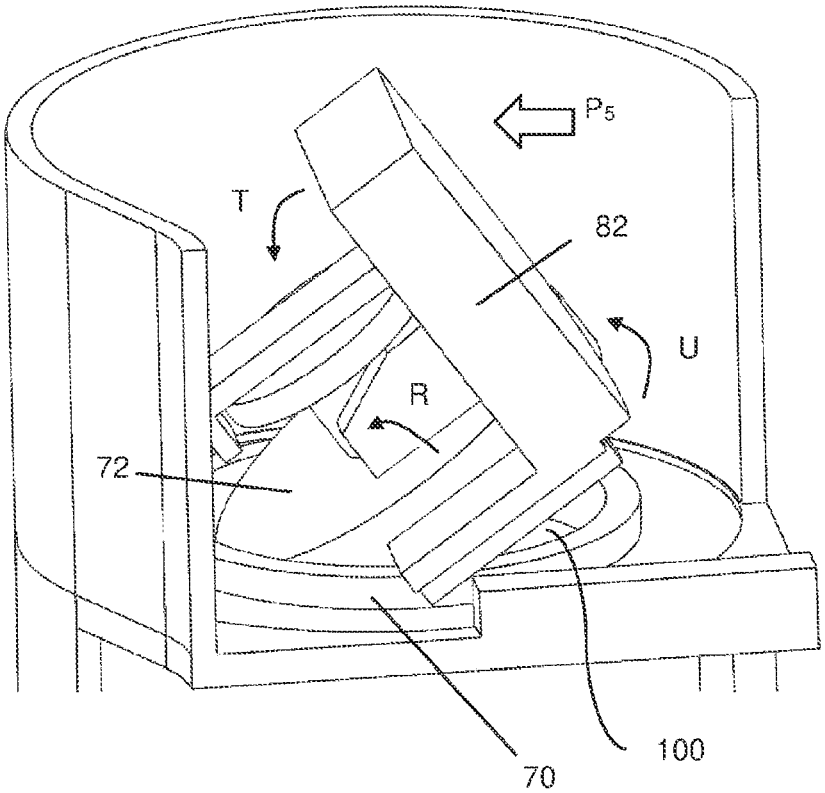
FIG. 15 is an isometric view of a cross section through A-A of FIG. 5, at a fifth transition point between the inoperative state and the operative state.
Figure 16:
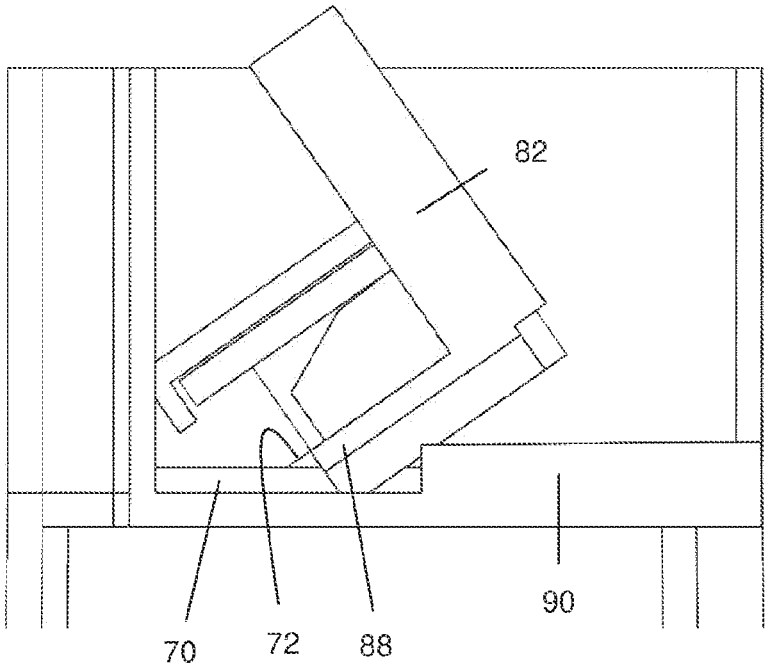
FIG. 16 is an elevation of the cross section through A-A of FIG. 5, in the fifth transition point of FIG. 13.
Figure 17:
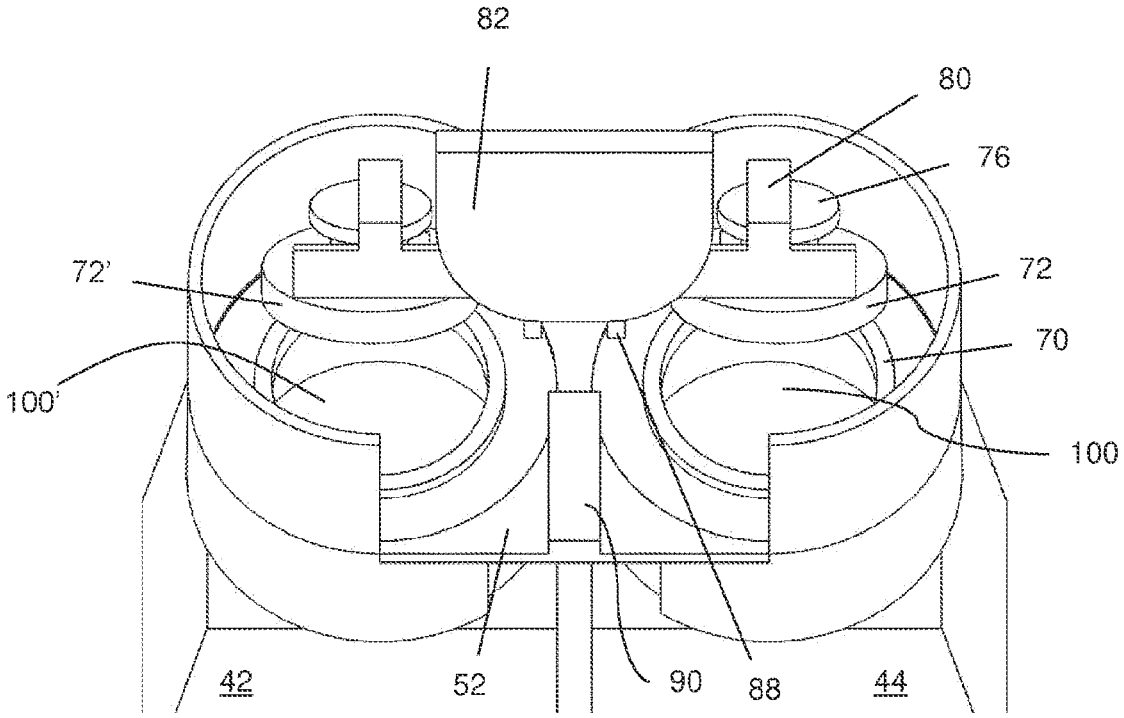
FIG. 17 is a front isometric view of the closure in the fifth transition point between the inoperative state and the operative state.

As the tab 82 is continues to be pushed as indicated by P5 in FIG. 15 the pivoting continues, which continues to open the hole 100 until the stopper 72 is fully released from the hole 100 as indicated by FIG. 17. Typically, this occurs while the container 50 is open side up. The container 50 is thus in an open state.

The bag 10 is then inverted and lowered into the drill hole (not shown). In doing so the container is inverted to be in the orientation shown in FIG. 1. The release actuator assembly 120 holding the stopper 72 then falls away as indicated by F and the contents of each chamber 42, 44 of the container 30 then empty, as indicated by E1 and E2, into the inner reaction bag 14 so as to collect at the lowermost point 22 and commence the inflation fluid releasing reaction so as to inflate the bag 10.

Figure 20:
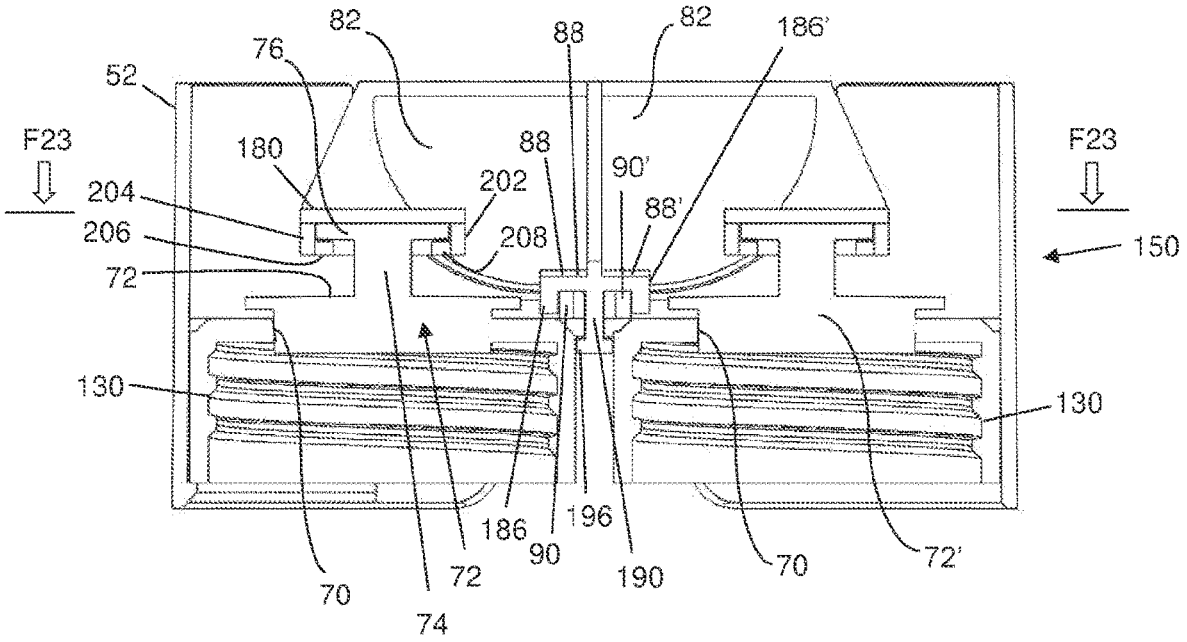
FIG. 20 is a vertical cross section (through F.20-F.20 of FIG. 22) of a further alternative closure of a reagent container according to another embodiment of the invention.

Referring to FIG. 20, an alternative embodiment of the closure 150, which comprises an alternative release actuator assembly 220, is shown. The closure 120 comprises similar components to closure 50, namely the closure comprises the caps 130 and a skirt 60, which is clipped to the underside of the caps 130 so as to hold the skirt 60 in place.

The release actuator assembly 220 is held in place, for example using similar wings 114 (to those of the release actuator assembly 120) extending from a tab 82 of the release actuator assembly 220. The wings 114 interfere with protrusions 112 on the inside of the skirt 60.

In an embodiment, the release actuator assembly 220 comprises a stopper withdrawing mechanism, similar in function to the embodiment of 120, but different in form, and a trigger. Pressing on the trigger operates the stopper 72 withdrawing mechanism. The trigger comprises the plate 82 for receiving pressure to operate the trigger. Each stopper 72 (and 72') comprises a disc forming the body of the stopper 72 which seals the respective hole 100 in the respective cap 130, which hole 100 is defined by a respective lip 70 (and 70'). The stopper 72 also comprises an axially aligned projection 74 and a hat 76. The projection 74 and the hat 76 form a T-shape in cross section, and with the disc form a somewhat H shape in cross section.

The skirt 60 also comprises a platform 90 between the lips 70, 70' in the form of a projecting stripe that extends from the skirt 60. The release actuator assembly 120 further comprises a holder for restraining the stopper 72, a slide 88 and the platform 90. The release actuator assembly 220 moves as the tab 82 is pushed. In particular, the slide 88 slides over the platform 90 as the tab 82 is pushed. In an embodiment, walls 186, 186' are on the sides (preferably outsides) of the platform 90 and another (complementary) platform 90' and ensure the release actuator assembly 120 is restricted to move in a direction aligned with the lengths of the platforms 90, 90'. The holder comprises an upper member 180 disposed above the hat 76 for preventing upward movement of the stopper 72 relative to the opening. Thus, the stopper 72 is held closed until the trigger is activated.

The release actuator assembly 120 is held in within the skirt 60 by a retention mechanism until the trigger is fully actuated. In an embodiment, the retention mechanism comprises a downward projection 190 having a flange 196 and in this case opposite facing flanges. The flanges 196 fit between and may contact the caps 130. Connected to the skirt 60 and the platform 90 is inward projection 192 (for each cap) against which the downward projection 190 can slide and under which the flange 196 slides. The inward projection 192 retains the flange 196 and thus the projection 190 and in turn the release actuator assembly 120 until the flange reaches an opening 194, whereupon the flange 196, which is sized to fit through the opening 194, can move though so as to release the release actuator assembly 120. The opening 194 is positioned such that the trigger has engaged the stopper 72, and in some embodiments, removes the stopper 72 from the opening 100.

Figure 23:
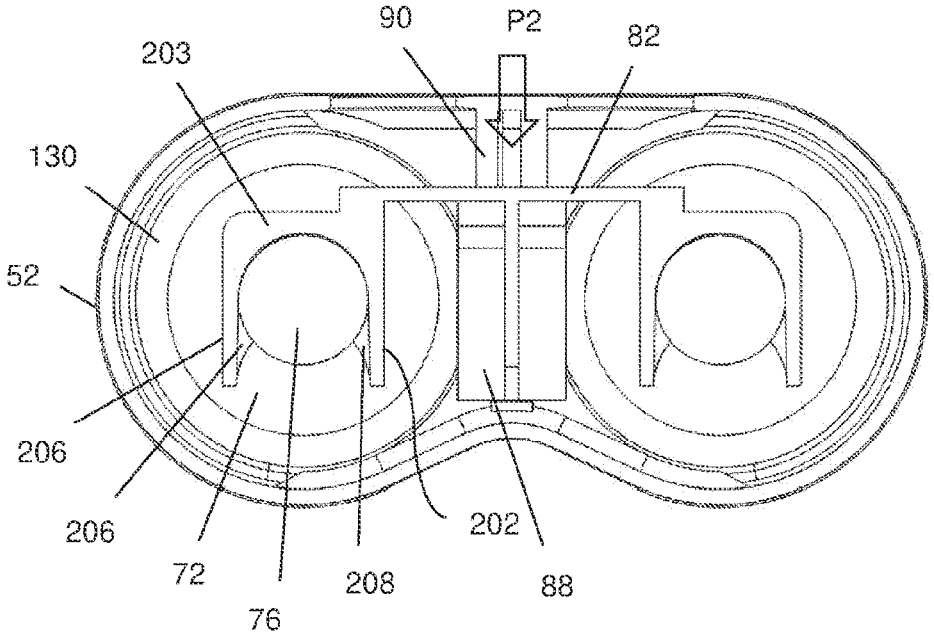
FIG. 23 is a horizontal cross section (though F.23-F.23 of FIG. 20 as if it were not a cross-section) of the closure of FIG. 21.

Preferably, the holder comprises a lower member 206, 208 disposed below the hat 76 and between with the projection 74 is able to be received for preventing downward movement of the stopper 72 relative to the opening. Preferably the lower member 206, 208 is preferably initially not in contact with the hat 76, but when the trigger is activated the holder and in particular the lower member 206, 208 moves underneath the flange of the hat 76. Preferably, the holder comprises a vertical portion 202, 203, 204 extending between upper member 180 and the lower member 206, 208. Preferably the vertical portion 202, 203, 204 is curved to conform to the shape of a matching part of the hat 76. Preferably a rear part 203 of the vertical portion (seen in FIG. 23) pushes against the matching part of the hat 76 when the trigger is activated, thus the holder comes into engagement with the hat 76.

Figure 21:
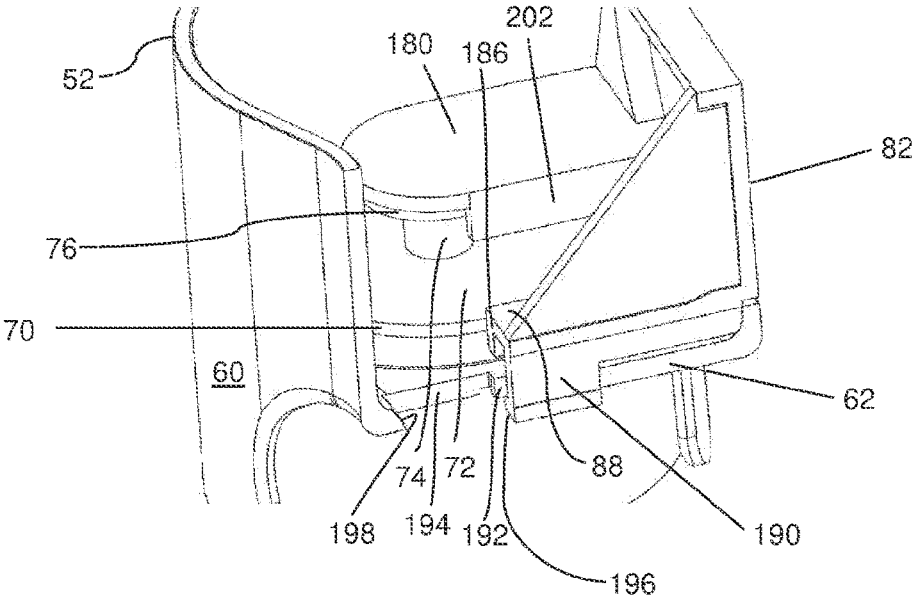
FIG. 21 is an isometric view of the closure of FIG. 20.
Figure 22:
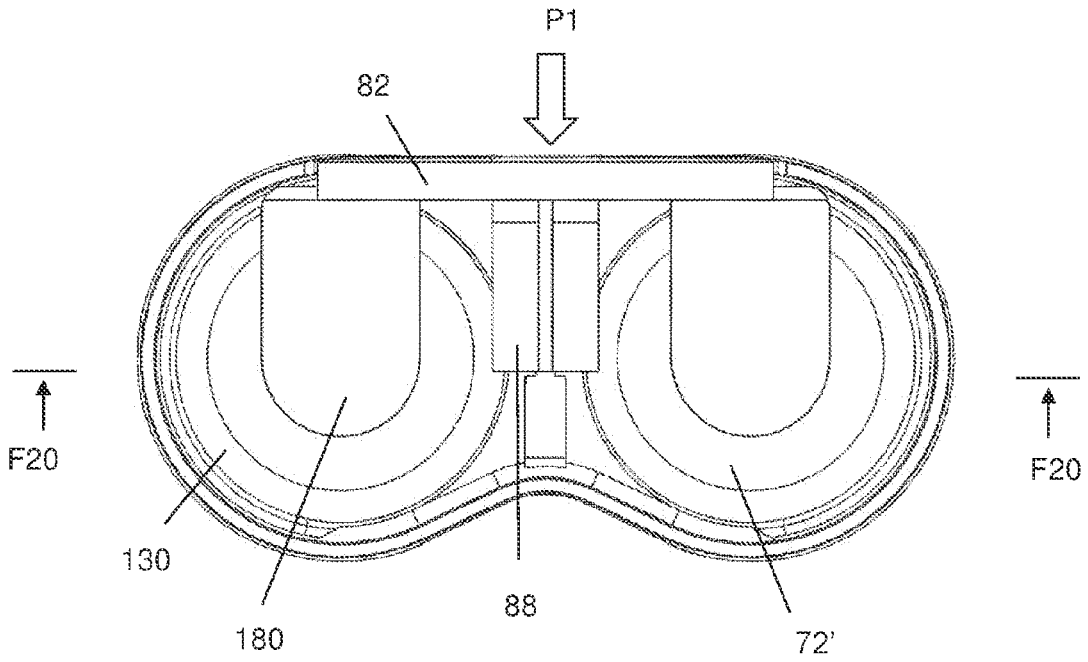
FIG. 22 is a plan view of the closure of FIG. 21.

The release actuator assembly 220 is in an inoperative state as shown in FIGS. 20 to 22. To operate the release actuator assembly 120 a user presses the tab 82 as indicated by P1 in FIG. 22.

Pressing the tab 82 causes the wings 114 to flex until they are released from the protrusions 112, such that the protrusions no longer hold the wings 114 and thus the release actuator assembly 120 captive in the skirt 60.

Further, slide 88 moves along the platform 90 and the holder engages the hat 76. Then, when the rear part 203 of the vertical portion contacts the hat 76, further pressure on the tab 82, indicated by P2, causes the rear part 203 to lift and pivot the stopper 72. A wedge mechanism similar to that described above may also be used at this point. In an embodiment the opening 194 is defined by a ramped surface 198, which acts as a wedge mechanism by pushing the flange 196 relatively upward, which in turn causes the release actuator assembly 120 and the held stopper 72 to be lifted. Lifting of the stopper 72 lifts it out from its interference fit in the hole 100 defined by the lip 70.

This embodiment of the release actuator assembly 220 is able to hold the stopper 72 in place against a force this might overcome the interference fit. Accordingly, this embodiment may use a lower force requirement to dislodge the stopper 72 from the opening 100 in comparison to the embodiment of the release actuator assembly 120 that used resilience of the latch 80 to hold the stopper 72 in place and the wedge mechanism, including wedge member 84, to overcome the interference fit so as to lift the stopper 72 from the hole 100.

When the release actuator assembly 220 has fully released the stopper 72 from the hole 100 it can fall away and the contents of each chamber 42, 44 of the container 30 can then empty, as indicated by E1 and E2 in FIG. 1, into the inner reaction bag 14 so as to collect at the lowermost point 22 and commence the inflation fluid releasing reaction so as to inflate the bag 10.

The skilled reader would readily appreciate the nature of the materials appropriate for making the components of the embodiments of the arrangements described herein. Modifications and variations as would be apparent to the skilled addressee are intended to be covered by the accompanying claims.

Future patent applications maybe filed in Australia or overseas on the basis of, or claiming priority from, the present application. It is to be understood that the following claims are provided by way of example only and are not intended to limit the scope of what may be claimed in any such future application. Features may be added to or omitted from the provisional claims at a later date so as to further define or re-define the invention or inventions.

The invention claimed is:

1. An inflatable down hole bag, comprising:

an inflatable body for holding an inflation fluid;

a container for holding at least two substances each held in a respective chamber of the container, the container being disposed inside of the inflatable body;

wherein the container comprises a closure for keeping the substances in the container when the closure is in an inoperative state, the closure also for releasing the substances from the container when the closure is in an operative state;

wherein release of the substances causes an inflation fluid producing reaction within the inflatable body, thereby inflating the inflatable body;

wherein each chamber comprises a respective opening, the closure comprises a plurality of stoppers, each stopper for closing each respective opening, and the closure further comprises an actuator for removing each stopper from each respective opening so as to release each substance from each respective chamber.

2. An inflatable down hole bag according to claim 1, wherein the actuator comprises a stopper withdrawing mechanism and a trigger, wherein pressing on the trigger operates the stopper withdrawing mechanism.

3. An inflatable down hole bag according to claim 2, wherein the trigger comprises a contact tab for receiving pressure to operate the trigger.

4. An inflatable down hole bag according to claim 3, wherein each stopper is in an interference fit with each respective opening.

5. An inflatable down hole bag according to claim 2, wherein the each stopper withdrawing mechanism restrains the stopper from opening until the trigger is activated.

6. An inflatable down hole bag according to claim 2, wherein the stopper withdrawing mechanism comprises a pivot mechanism for pivoting a side of each stopper relative to a body of the container.

7. An inflatable down hole bag according to claim 2, wherein the stopper withdrawing mechanism comprises an engagement mechanism for engaging a portion of each stopper and a pivot mechanism for pivoting a side of each stopper relative to the each respective opening of the container.

8. An inflatable down hole bag according to claim 1, wherein the inflatable body comprises a reaction bag within the inflatable body and wherein the container is disposed inside the reaction bag.

9. An inflatable down hole bag according to claim 8, wherein the reaction bag comprises a sloped internal surface when the inflatable down hole bag is oriented for lowering into the hole such that the substances are urged to move to a lowermost part of the reaction bag under the influence of gravity.

10. An inflatable down hole bag according to claim 8, wherein the reaction bag comprises a first reagent substance within one or more dissolvable skins and at least one of the substances within the container is a second reagent capable of dissolving the dissolvable skin, and the first and second reagents when in contact produce or contribute to the production of the inflation fluid producing reaction.

11. A container for release of two or more reactive substances into an inflatable down hole bag, comprising:

a single container body for holding two or more substances; and a closure for keeping the two or more substances in the container when the closure is in an inoperative state, the closure also for releasing the one or more substances from the container when the closure is in an operative state;

wherein release of the two or more substances causes an inflation fluid producing reaction within the inflatable body, thereby inflating the inflatable body; wherein, the container comprises at least two separated chambers, each chamber for holding a respective one of the substances, wherein, the closure comprises a plurality of stoppers, wherein each stopper closes a respective opening to each of the chambers;

wherein, in response to the closure being changed from the inoperative state to the operative state, the stopper for each chamber is opened.

12. A container according to claim 11, wherein the closure further comprises an actuator for removing each stopper from the respective opening so as to release each substance from each respective chamber.

13. A container according to claim 12, wherein the actuator comprises a stopper withdrawing mechanism and a trigger, wherein pressing on the trigger operates the stopper withdrawing mechanism.

14. A container according to claim 13, wherein the stopper withdrawing mechanism restrains the each stopper from opening until the trigger mechanism is activated.

15. A container according to claim 13, wherein the stopper withdrawing mechanism comprises a pivot mechanism for pivoting a side of each stopper relative to a body of the container.

16. A container according to claim 13, wherein the stopper withdrawing mechanism comprises an engagement mechanism for engaging a portion of each stopper and a pivot mechanism for pivoting a side of each stopper relative to each respective opening.

17. A method of inflating a down hole bag, comprising:

providing an inflatable bag having an inflatable body for holding an inflation fluid; the bag comprising a container for holding two or more substances in at least two separated chambers, each chamber for holding a respective one of the substances, the container being disposed inside of the inflatable body, the container comprising a closure which comprises a plurality of stoppers, wherein each stopper closes each respective opening of the chambers;

activating an actuator of the container so as to change it from an inoperative state where the one or more substances in the container are held therein to an operative state wherein upon the change from the inoperative state to the operative state removes each stopper from the respective opening so as to release each of the substances of each respective chamber of the container into the inflatable body;

wherein release of the one or more substances causes an inflation fluid producing reaction within the inflatable body, thereby inflating the inflatable body.

18. A method of opening a container for release of two or more reactive substances into an inflatable down hole bag, comprising:

providing a container having a body for holding the two or more substances in at least two separated chambers, each chamber for holding a respective one of the substances; and a closure for keeping the substances in the container when the closure is in an inoperative state, the closure comprises a plurality of stoppers, wherein each stopper closes a respective opening to each of the chambers, the closure also comprising an actuator for releasing the substances from the container when the closure is in an operative state;

activating the closure so as to remove each stopper from the respective opening so as to release the substances such that they cause an inflation fluid producing reaction within the inflatable bag.

* * * * *